United States Patent [19]

Gutierrez et al.

[11] 4,411,808

[45] Oct. 25, 1983

[54] MULTIFUNCTIONAL ADDITIVE FOR POWER TRANSMISSION SHIFT FLUIDS

[75] Inventors: Antonio Gutierrez, Mercerville; Stanley J. Brois, Westfield; Jack Ryer, East Brunswick; Harold E. Deen, Cranford, all of N.J.

[73] Assignee: Exxon Research & Engineering Co., Florham Park, N.J.

[21] Appl. No.: 405,297

[22] Filed: Aug. 4, 1982

[51] Int. Cl.[3] ..... C10M 1/00; C10M 3/32

[52] U.S. Cl. ..... 252/78.1; 252/48.6; 252/56 D; 252/73; 252/75; 252/76; 252/79; 252/395; 252/406

[58] Field of Search ..... 252/48.6, 560, 73, 75, 252/76, 79, 395, 406, 78.1

[56] References Cited

U.S. PATENT DOCUMENTS

| | | | |
|---|---|---|---|
| 3,136,748 | 6/1964 | Miller et al. | 252/48.6 |
| 4,264,460 | 4/1981 | Gutierrez et al. | 252/48.6 |
| 4,344,853 | 8/1982 | Gutierrez et al. | 252/48.6 |

*Primary Examiner*—John E. Kittle
*Assistant Examiner*—Robert A. Wax
*Attorney, Agent, or Firm*—John J. Mahon

[57] ABSTRACT

There are disclosed power shaft transmission fluids such as automatic transmission fluids containing a multifunctional anti-oxidant, anti-corrosion and friction modification additive being an oil soluble aliphatic succinate ester of alkoxylated mercaptan.

7 Claims, No Drawings

MULTIFUNCTIONAL ADDITIVE FOR POWER TRANSMISSION SHIFT FLUIDS

This invention relates to power transmission shift fluids, such as automatic transmission fluids, which contain an additive effective as both a corrosion and oxidation inhibitor as well as providing friction modification benefits.

Mineral oil based power transmission shift fluids, or functional fluids, such as automatic transmission fluids are required to exhibit a number of properties such as antiwear, friction modification, oxidation inhibition, anticorrosion, demulsification and the like in order to qualify for commercial acceptance. Usually, a separate additive is required in order to provide the desired property to the fluid. The present invention is based on the discovery that certain oil soluble succinate esters of alkoxylated mercaptan compounds provide a multifunctional effect of copper and brass corrosion inhibition, effective antioxidation and desirable friction properties, all at relatively low concentrations.

In accordance with the present invention there have been discovered hydrocarbon mineral oil power transmission shift fluids comprising a major amount of a mineral oil of lubricating viscosity and an oil soluble multifunctional additive present in an amount effective to provide copper and brass corrosion inhibition, oxidation inhibition and friction modification, the additive being an oil soluble ester formed by esterifying equimolar proportions of a straight chain $C_{18}$–$C_{30}$ alkyl or thioalkyl, alkenyl or thioalkenyl succinic anhydride or acid with an ethoxylated or propoxylated alkyl mercaptan having 8 to 20 carbon atoms and containing 1 to 6 moles of adducted ethylene or propylene oxide per mole of said alkyl mecaptan or mixtures of ethylene and propylene oxide.

Illustrative preferred compounds are the oil soluble esters formed by reacting octadecyl or octadecenyl thiosuccinic anhydride with propoxylated or ethoxylated dodecyl mercaptan of the formula $C_{12}H_{24}S(CH_2CH_2O)_5H$. Particularly preferred for use in the compositions of the present invention is the ester of octadecenyl succinic anhydride with the 1 mole propoxylate adduct of dodecyl mercaptan.

The compositions of the present invention may contain the additive generally within the range of about 0.01 to 1 wt % to provide the effective antioxidation, corrosion inhibition and friction properties. Preferably, the power transmission shift fluids will contain about 0.1 to 0.5 wt% of the multifunctional additive of the present invention.

In addition to use in automatic transmission fluids the additive of the present invention will function as an oxidation inhibitor, corrosion inhibitor and friction modifier in other power transmission shift fluids based on mineral oils such as hydraulic fluids, power brake and power steering fluids, heavy duty equipment fluids and the like.

The present invention is considered a substantial advance in the field of formulated power shift transmission fluids in that one additive will provide the properties normally associated with three or more additives, i.e. oxidation inhibition, corrosion inhibition and friction modification, and these properties are achieved at a treatment or concentration level substantially lower than that required when the conventional systems are used which typically require two or three distinct additives.

Friction modification is one of the most demanding properties to effectively provide in an automatic transmission fluid and is considered the characteristic which distinguishes ATF compositions from other categories of lubricants. Very specific frictional properties related to transmission parts operation must be met in order to have an acceptable fluid. The additive of the present invention is highly advantageous in that it satisfies a significant friction modification test and simultaneously provides corrosion control and oxidation inhibition, thereby substantially reducing the complexity and cost of an effective automatic transmission fluid. The properties evaluated in ATF tests and specifications are generally applicable to other power shift transmission fluids.

Automatic transmission fluids containing the multifunctional additive of the present invention are the preferred embodiment. Improvements in oxidation stability of ATF has become recently of greater importance because of smaller sump capacities and increased load on a car's cooling system has increased transmission operating temperatures. Such ATF compositions contain a number of conventional additives in amounts providing their normal attendant functions and are typically blended into the mineral oil base in the following ranges:

| Components | Concentration Range (Vol. %) |
|---|---|
| V.I. Improver | 1-15 |
| Corrosion Inhibitor | 0.01-1 |
| Oxidation Inhibitor | 0.01-1 |
| Depressant | 0.5-10 |
| Pour Point Depresant | 0.01-1 |
| Demulsifier | 0.001-0.1 |
| Anti-Foaming Agent | 0.001-0.1 |
| Anti-Wear Agent | 0.001-1 |
| Seal Swellant | 0.1-5 |
| Friction Modifier | 0.01-1 |
| Mineral Oil Base | Balance |

Typical base oils for automatic transmission fluids and power transmission shift fluids generally include a wide variety of light hydrocarbon mineral oils, such as, naphthenic base, paraffin base and mixtures thereof, having a lubricity viscosity range of about 34 to 45 SUS (Saybolt Universal Seconds) at 100° C.

The invention is further illustrated by the following examples which are not to be considered as limitative of its scope. ATF compositions used in the examples below were formulated in accordance with the components (except corrosion inhibitor, oxidation inhibitor and friction modifier) and concentrations noted above and are referred to as Base Fluid.

EXAMPLE 1

Additive A was an oil-soluble ester prepared by esterifying 1 mole of octadecenyl succinic anhydride with 1 mole of the 5 mole ethoxylate of dodecylmercaptan.

Additive B was an oil soluble ester prepared by esterifying 1 mol of thiooctadecenyl succinic anhydride with 1 mole of the 5 mole ethoxylate of dodecylmercaptan.

Additive C was the ester prepared from equimolar preparations of octadecenyl succinic anhydride and the mole propoxylate of dodecyl mercaptan.

Additive D was the ester prepared from equimolar proportions of octadecenyl succinic anhydride and a mixture of the 1-3 mole ethoxylate of dodecyl mercaptan.

Additive E was the ester prepared from equimolar proportions thiooctadecenyl succinic anhydride and the mole propoxylate of dodecyl mercaptan.

To a formulated automatic transmission fluid (Base Fluid) was added 0.4 wt% of each of the additives A, B, C, D and E. The fluids were evaluated in the LMOT (Laboratory Multiple Oxidation Test) and comparison was made with the Base Fluid. The same sample fluids were evaluated in Example 2.

In the LMOT test 50 ml. of the test fluid containing 2.0 g iron filings plus O.5g of a 1% solution of and copper naphthenate oxidation catalyst is heated to 300° F. and 25 ml. of air per minute is bubbled through the sample. Daily samples are taken and blotter spots of the samples are observed for sludge. The number of days it took for visible sludge to appear is the measured rating of the antioxidation effect. A rating of 10-11 days or more is considered a "pass". The results are given below:

| LMOT RESULTS | |
|---|---|
| Base Fluid | 7 days |
| Base Fluid & Additive A | 16 days |
| Base Fluid & Additive B | 17 days |
| Base Fluid & Additive C | 13 days |
| Base Fluid & Additive D | 13 days |
| Base Fluid & Additive E | 16 days |

EXAMPLE 2

Copper and brass corrosion tests were conducted which comprised immersing copper and brass specimens $3 \times \frac{1}{2} \times 1/6$ inches weighed to 0.1 milligram in 40 cc. of the Example 1 ATF and maintaining the specimens in the fluid at 300° F. for 65 hours. Thereafter the specimens are washed in hexane, rubbed to remove any loose deposits and reweighed. Values of 30 mg copper and 15 mg brass, or less, are considered passing values for this test. These results, tabulated below satisfy current commercial specifications for automatic transmission fluids such as the General Motors Corp. specification for Dexron ®II Automatic Transmission Fluid.

| ATF | Cu loss, mg | Brass loss, mg |
|---|---|---|
| Additive A | 11.3 | 5.3 |
| Additive B | 10.5 | 5.5 |
| Additive C | 24.7 | 8.0 |
| Additive D | 10.7 | 12.2 |
| Additive E | 22.2 | 13.7 |

EXAMPLE 3

ATF compositions containing the same additives evaluated in Example 1 and 2 also performed satisfactorily in the Davison Friction Test.

What is claimed is:

1. A power shift transmission fluid composition comprising a major amount of a hydrocarbon mineral oil of lubricating viscosity containing an oil soluble additive in an amount effective to provide oxidation inhibition, copper and brass corrosion inhibition and friction modification to said fluid, said additive being an ester formed by esterifying equimolar proportions of a straight chain $C_1$-$C_{30}$ alkenyl, alkyl, thioalkyl or thioalkenyl succinic acid or anhydride with an ethoxylated or propoxylated alkyl mercaptan having 8 to 20 carbon atoms and containing 1-6 moles of ethylene oxide or propylene oxide per mole of said alkyl mercaptan.

2. The composition of claim 1 wherein there is present 0.01 to 1 wt % of said additive.

3. The composition of claim 1 wherein said composition is an automatic transmission fluid.

4. The composition of claim 3 wherein the succinic acid or anhydride has 18 carbon atoms.

5. The composition of claim 3 wherein the alkyl mercaptan is the 1 mol propoxylate of dodecyl mercaptan.

6. The composition of claim 5 wherein there is present about 0.1 to 0.5 wt % of said additive.

7. The composition of claim 5 wherein the additive is the ester of octadecenyl succinic anhydride with the 1 mol propoxylate of dodecyl mercaptan.

* * * * *